US006935974B2

(12) United States Patent
Filippini

(10) Patent No.: US 6,935,974 B2
(45) Date of Patent: Aug. 30, 2005

(54) RACQUET STRUNG WITH BYPASS STRING PATTERN

(75) Inventor: Rafael G. Filippini, Chula Vista, CA (US)

(73) Assignee: EF Composite Technologies, L.P., San Diego, CA (US)

( * ) Notice: Subject to any disclaimer, the term of this patent is extended or adjusted under 35 U.S.C. 154(b) by 0 days.

(21) Appl. No.: 10/866,890

(22) Filed: Jun. 14, 2004

(65) Prior Publication Data

US 2004/0224800 A1 Nov. 11, 2004

Related U.S. Application Data

(62) Division of application No. 10/150,409, filed on May 17, 2002, now Pat. No. 6,764,417.

(51) Int. Cl.[7] ..... A63B 51/00
(52) U.S. Cl. ..... 473/543; 473/540
(58) Field of Search ..... 473/524, 537, 473/543, 540, 548

(56) References Cited

U.S. PATENT DOCUMENTS

| | | | | |
|---|---|---|---|---|
| 1,188,940 | A | * 6/1916 | Johnson | 473/543 |
| 4,118,029 | A | 10/1978 | Septier | |
| 4,162,791 | A | 7/1979 | Seehase | |
| 4,299,385 | A | * 11/1981 | Boden | 473/543 |
| 4,765,621 | A | 8/1988 | Game | |
| 5,054,779 | A | 10/1991 | Marrello | |
| 5,232,219 | A | 8/1993 | Tseng | |
| 5,255,912 | A | 10/1993 | Tseng | |
| 5,263,709 | A | 11/1993 | Tseng | |
| 5,342,044 | A | 8/1994 | You | |
| 5,383,662 | A | 1/1995 | Gabrielidis | |
| 5,435,550 | A | 7/1995 | You | |
| H1710 | H | 2/1998 | Davis | |
| 5,919,104 | A | 7/1999 | Mortvedt et al. | |
| 5,993,337 | A | 11/1999 | Janes et al. | |
| 6,050,909 | A | 4/2000 | Severa et al. | |
| 6,062,994 | A | 5/2000 | Grimes et al. | |
| 6,432,005 | B1 | 8/2002 | Lin | |
| 6,764,417 | B1 * | 7/2004 | Filippini | 473/548 |

OTHER PUBLICATIONS

MacGregor Bergelin LongString tennis racquet stringing instructions, The Stringer's Digest, 1987. pp. 78–79.*

* cited by examiner

*Primary Examiner*—Raleigh W. Chiu
(74) *Attorney, Agent, or Firm*—Daspin & Aument, LLP; Jefferson Perkins

(57) ABSTRACT

A sports racquet strung with a bypass string pattern has a frame with a first side and an opposed second side. The second side of the frame has a plurality of spaced apart string anchoring points. A string bed including a string having a plurality of string segments each strung between the first side and the second side of the frame using the string anchoring points. The string bed includes first and second string segments that are adjacent each other on the string, substantially parallel to each other in the string bed, but are spaced apart from each other in the string bed by at least two other string segments strung substantially parallel to the first and second string segments.

15 Claims, 5 Drawing Sheets

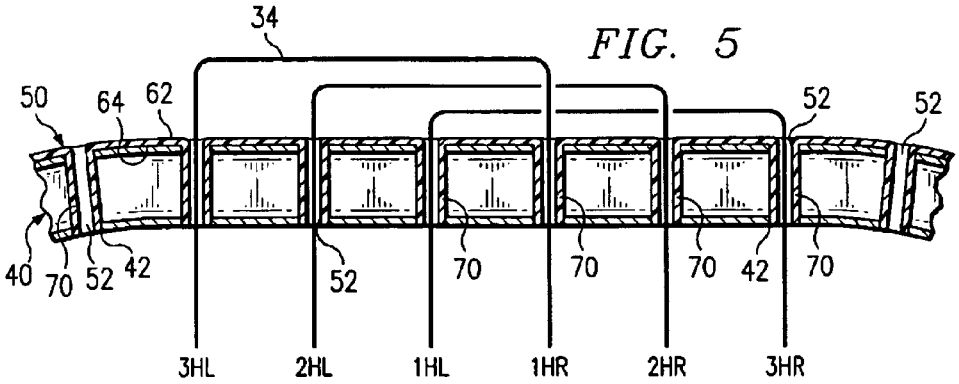
FIG. 5
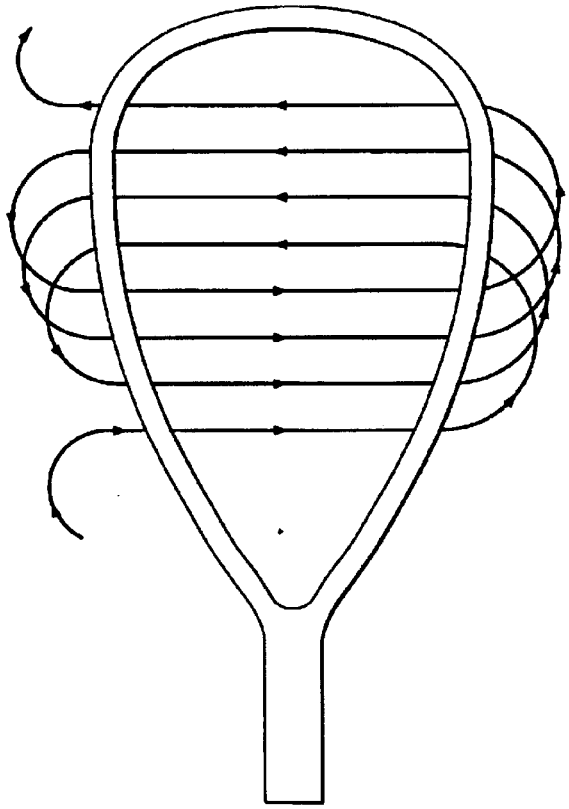
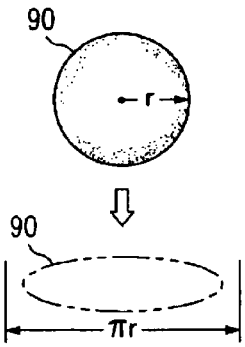
FIG. 6
FIG. 12

RACQUET STRUNG WITH BYPASS STRING PATTERN

RELATED APPLICATIONS

This application is a division of U.S. patent application Ser. No. 10/150,409, now U.S. Pat. No. 6,764,417 filed May 17, 2002 and fully incorporated by reference herein.

TECHNICAL FIELD OF THE INVENTION

The present invention relates in general to sports racquets, such as tennis rackets, badminton racquets, squash racquets and racquetball racquets used for hitting a projectile such as a ball, and more particularly to a method of stringing a sports racquet used for hitting a projectile.

BACKGROUND OF THE INVENTION

In the most conventional sort of strung sports racquets, the striking area is defined by a head frame that is roughly oval in shape. "Racquet," as used herein, encompasses racquetball racquets, tennis rackets, badminton racquets, squash racquets and any other sports implement that has a head which is strung with string or netting and which is designed to intercept and return a projectile. Holes are made through the frame, typically in the plane of the strung area, for the passage of string therethrough. Racquets are generally strung such that one string weaves through the holes that are positioned on opposite sides of the frame in a consecutive fashion, forming multiple string segments. As a result, two directly connected segments of the string are situated adjacent each other in the strung racquet.

As the ball impacts a string, a tensile force is placed on the string which will have a tendency to pull the string through the string hole, and this tensile force is communicated to the adjacent string segment of the string. If the adjacent string segment is not also impacted, there would be a tendency of the adjacent strung segment to relieve some of the tensile force by lengthening. However, when two adjacent string segments are impacted at the same time, there is no opportunity for one string segment to relieve the stress placed on the other. Instead, tensile force is exerted on both string segments toward the projectile but in opposite directions on the string of which the string segments are a part, tending to pull the string apart. This acute stress shortens the life of the string and causes string failure. Further, where a large component of a ball's momentum is absorbed by a single string segment, other segments adjacent on the continuous string to the impacted segment can contribute to the impacted strings elongation and resiliency, thereby contributing a more lively feeling to play. But where two or more segments that are adjacent each other on the continuous string absorb substantial portions of a ball's impact, they are less available in permitting each other to yield or deflect. This results in a more wooden or boardlike feel to play.

Thus, it is desirable to improve the life of strings of a sports racquet and to reduce the amount of stress the ball exerts at impact on each of the connected string segments, and it is desirable to enhance liveliness and resiliency in the behavior of impacted string segments.

SUMMARY OF THE INVENTION

One aspect of the invention is a method used to string a sports racquet for hitting a projectile and the string racquet produced thereby. The method includes the step of drawing a string from a first side of a racquet frame toward a second side opposite the first side to form a first string segment. The string is strung through a string anchoring point at a first location on the second side and drawn from the first location on the second side to a second location on the second side. The string is then strung through a string anchoring point at the second location and passed back to the first side of the frame. The second side is spaced from the first side a predetermined distance that is preselected such that the projectile cannot substantially impact both the first and second string segments when the racquet hits the projectile.

Another method for stringing a sports racquet includes the step of drawing a string from a first side of the racquet frame toward a second side opposite the first side to form a first string segment. The string is strung through a first string hole at a first location on the second side. The string is drawn from the first location on the second side to a second location on the second side spaced from the first location. The string is then strung through a second string hole at the second location. The string is then passed back to the first side of the frame with at least two other string holes on the frame interposed between the first and second string holes. The result is a string racquet in which string segments that are adjacent each other on the string occupy positions in the string that are substantially parallel to each other but which are spaced apart by at least two other, and in some embodiments three or more, string segments.

Another aspect of the invention is directed to a string anchoring system for a sports racquet. The string anchoring system preferably includes a bumper having an outer surface, an inner surface and a plurality of anchoring points formed therethrough. The bumper surrounds an outer edge of a frame of the sports racquet and the anchoring points are adapted to guide a string through the frame of the sports racquet. A first string path is formed in the outer surface of the bumper between a first and second location and a second string path is formed in the outer surface of the bumper between a third and fourth location. The third, first, fourth and second locations are linearly arranged along the outer surface such that the fourth location is between the first and second locations. The second string path is displaced from the first string path such that the first and second string paths are adapted to receive string portions wherein the string portions disposed in the string paths do not saw at each other. In a preferred embodiment, the string anchoring system defines three such overlapping string paths, which however are routed so as to substantially avoid each other. Alternatively, the string paths may be formed by an external top surface of the racquet frame itself rather than in a bumper.

The present invention is applicable to shafted as well as nonshafted racquets and to racquets of conventional string designs as well as "longstring" designs (see, e.g., U.S. Pat. No. 5,919,104 assigned to the assignee hereof). The present invention enhances string life as well as resiliency in play in that a ball cannot impart as much energy into two string-adjacent string segments at the same time. Therefore, these string-adjacent string segments (i.e., having the relation to each other shown in FIG. 2) are more able to contribute to the resiliency and deflection of those string segments taking most of the force.

BRIEF DESCRIPTION OF THE DRAWINGS

Further aspects of the invention and their advantages may be discerned from the following description when taken in conjunction with the drawings, in which like characters number like parts and in which:

FIG. 5 is a cross sectional view taken substantially along line 5—5 of FIG. 4, and illustrating a bypass string pattern according to the present invention;

FIG. 6 is a side view of a racquetball before and during an impact on a racquetball racquet string bed;

FIG. 12 is a schematic front view of a racquet strung using another form of the bypass string pattern.

DETAILED DESCRIPTION OF ILLUSTRATED EMBODIMENTS

Figure 1:
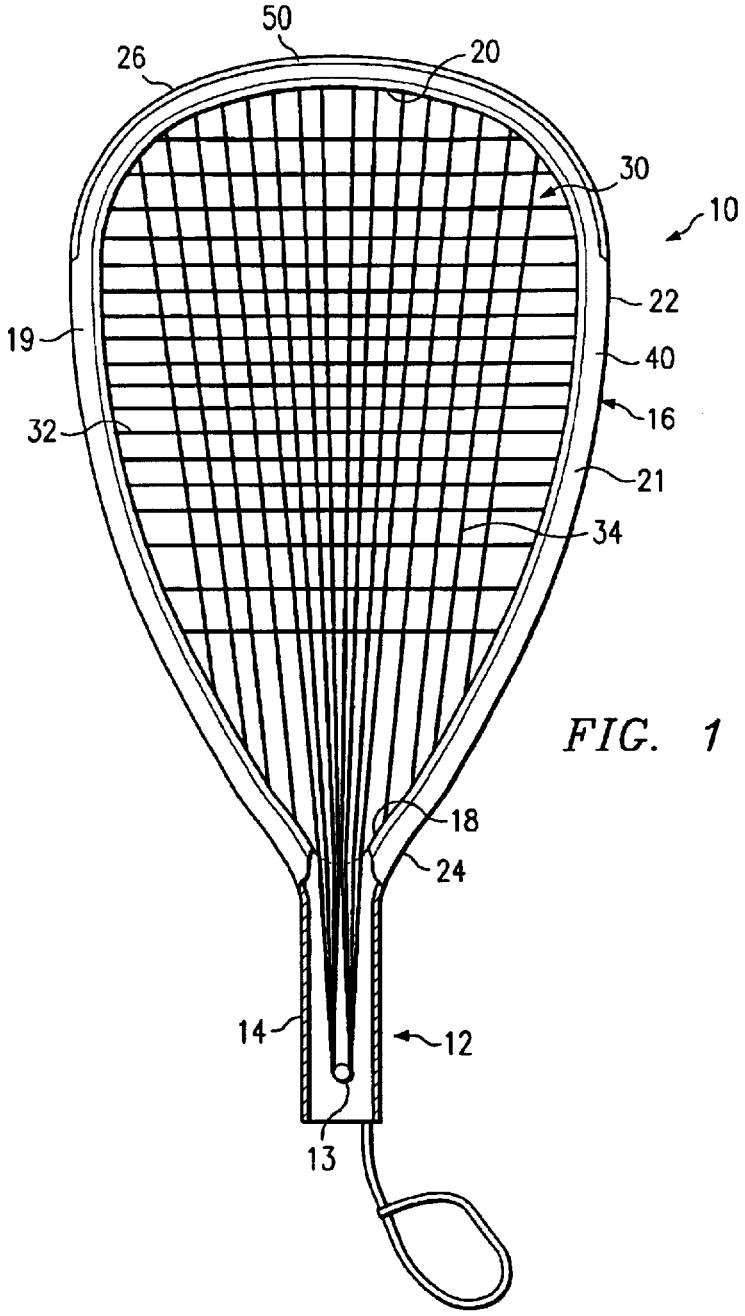
FIG. 1 is a front view of the sports racquet of the present invention, a portion of a handle being cut away to show internal detail.

FIG. 1 illustrates a sports racquet 10 strung by the bypass string pattern of the present invention. The sports racquet 12 includes a handle 14 and a frame 16 extending from the handle 14. While a nonshafted racquetball racquet 12 is illustrated, the present invention has equal application to shafted racquets such as those used for tennis, squash and badminton. The handle or stem 14 preferably is formed as a hollow chamber with a transverse anchoring pin 13 positioned therein (see also FIG. 12) for supporting the main string or "longstring" segments of the strung racquet. While the present invention has been illustrated using a "longstring" racquet, it has equal application to other racquets which do not extend the longitudinal string segments into a handle or stem. The frame 16 defines a head 22 and a narrow throat 24 that leads to the handle 14. The frame 16 includes opposed sides between which is strung a string bed 30. The string bed 30 is the portion of the racquet that is meant to contact a projectile, such as a ball or shuttlecock. The opposed sides of the frame include a first side 18 located at the throat 24 and a second side 20 opposite the first side 18 located at the top of the frame 16. The frame also includes lateral side portions 19 and 21.

The handle 14 and the frame 16 may be formed of any of several strong materials. Preferably, the handle and frame are formed from a laminated composite of resin-impregnated carbon fiber sheets.

Figure 2:
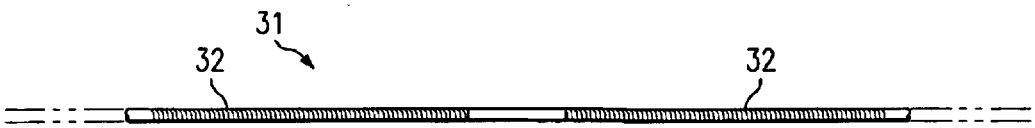
FIG. 2 is a side elevation view of a string used to string the sports racquet.

The racquet 10 includes a plurality of string segments. A string 31 of the sort used to string the sports racquet is illustrated in FIG. 2. The string 31 includes a plurality of segments 32 that are adjacent to each other on the string. In use, the string segments are positioned within the string bed 30 of the racquet 12. The string 31 forms horizontal segments 32 and vertical segments 34. The horizontal segments 32 are cross strings that extend between lateral sides 19 and 21. The vertical segments 34 include a plurality of main strings that are disposed at the center of the racquet 12. The main string vertical segments extend from the second side 20 of the frame 16 through the throat 24 of the frame 16, and around an anchoring pin 13 positioned in the handle as illustrated by commonly owned U.S. Pat. No. 5,919,104 to Mortvedt et al. The remainder of the vertical string segments extend from the first side 18 to the second side 20 of the frame 16 (see FIG. 12).

The frame 16 is comprised of a tubular support member 40 whose cross section is roughly oval in shape. The tubular support member 40 of the frame 16 includes a plurality of anchoring points or holes 42 (see FIG. 5) positioned around the head 22 of the frame 16 for receiving the racquet string.

Figures 3, 4:
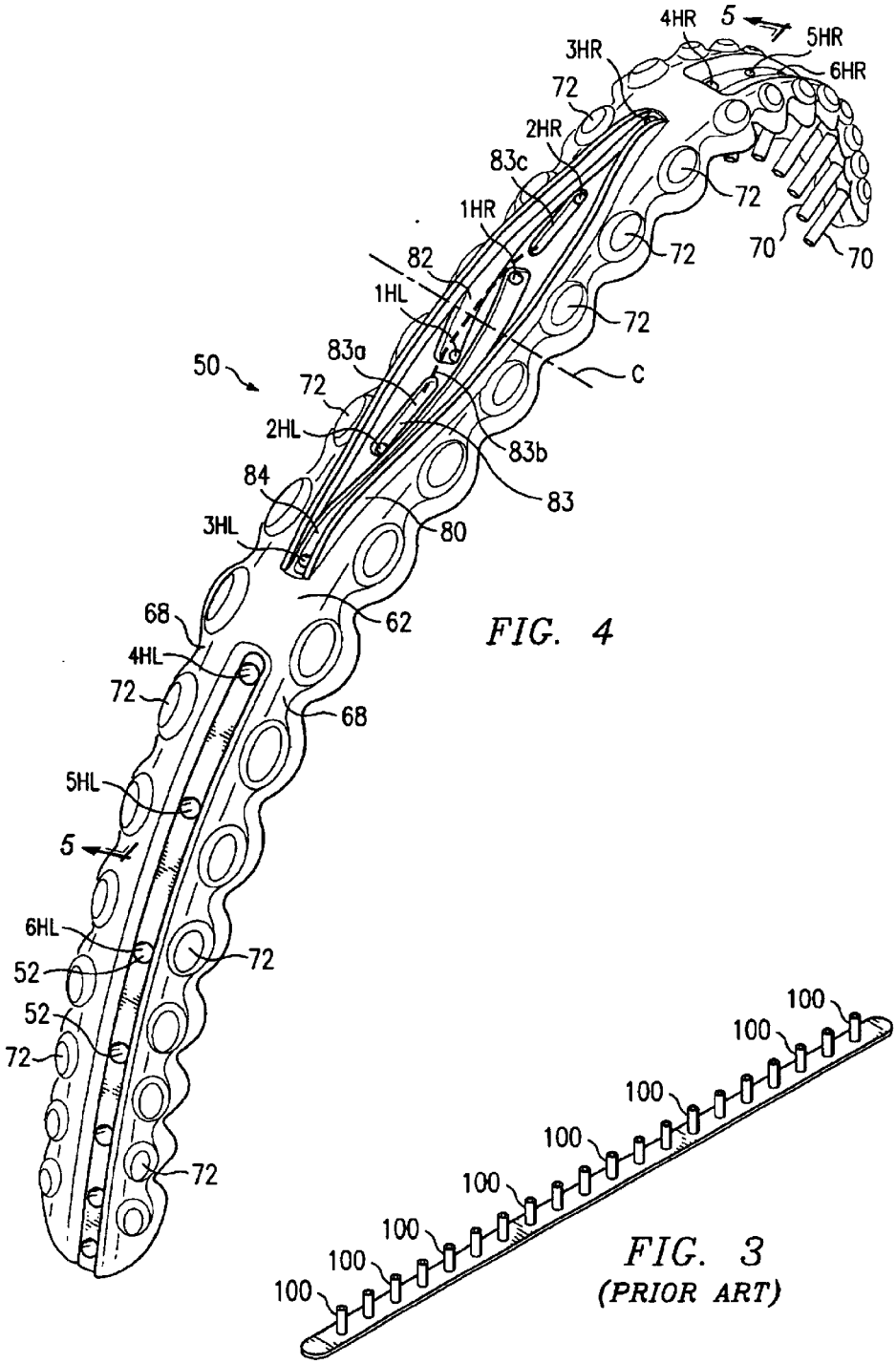
FIG. 3 (PRIOR ART)
FIG. 3 is a perspective view of a conventional bumper molding according to the prior art.
FIG. 4 is a top view of the bumper that is disposed on a racquet as illustrated in FIG. 1.

Bumpers are generally positioned around the top outer edge of the racquet. FIG. 3 illustrates a conventional prior art bumper which is normally laced to the bow or the top end of the racquetball racquets. The bumper is intended to protect the frame and the string segments of the racquet from court abrasions. In conventional designs using frames with string holes, the bumper provides grommets 100 that direct and protect strings as they penetrate through string holes in the frame.

General Electric developed a plastic, during the early 1970fs, for better impact and abrasion resistance. The generic "polycarbonate" was given the trademark LEXAN®. Current variations on this resin are manufactured by GE, Dow, Mobay, Polymer Resources, and Shuman.

This material was tested as a bumper in the present invention and appears to provide superior impact and abrasion resistance performance. Other materials may also be effective, such as other amorphous polyesters, or polyamides. Generally, any polymer which meets a criterion of greater than 10 ft-lbs./inch of notch according to the ASTM D256A testing standard (Izod impact, ⅛" specimen) can be substituted. The benefits of using polycarbonate include better abrasion resistance, thus longer lasting string protection; better impact resistance, thus longer racquet service life; behavior as a structural adjunct for impact protection, therefore materials in the racquet structure dedicated to this purpose may be removed, or rededicated to stiffening the bow region; and easier racquet installation than is the case with conventional bumpers.

In the illustrated embodiment of FIG. 1, a bumper 50 surrounds the outer edge 26 of the top of frame 16. The bumper 50 provides a string anchoring system that guides the string while stringing the racquet. The bumper 50 is fit onto the outer surface of the tubular support member 40 of the frame 16 and centered at the top of the racquet. The bumper 50 may be bent around the periphery of the frame 16 from a piece of straight stock or may be custom molded. Preferably, the bumper 50 is stretched onto the tubular support member 40 of the frame 16 so that the bumper 50 is under tension.

A bumper 50 according to the invention includes an outer surface 62 (FIG. 4) and an inner surface 64 (FIG. 5) with a plurality of anchoring points or holes 52 therethrough. The bumper 50 also includes an outer edge 68 along each side of the outer surface 62. The plurality of anchoring points or holes 52 are spaced apart such that the bumper holes 52 align with the holes 42 in the tubular support member 40 of the frame 16.

The bumper 50 includes a plurality of spaced apart projections 72 that are aligned in a row along the edges 68 of the bumper 50. The projections 72 provide additional protection for the frame 16 from court abrasions.

FIG. 5 illustrates a cross-section of the bumper 50 installed on the tubular support member 40 of the racquet frame 16. The inner surface 64 of the bumper includes a plurality of downwardly extending grommets 70 wherein one grommet 70 extends from each of the holes 52 disposed in the bumper 50. The bumper 50 is positioned around the outer edge 26 of the frame 16 such that the downwardly extending grommets 70 of the inner surface 64 are inserted through the holes 42 in the frame 16. As a result, the inner surface 64 of the bumper 50 is positioned adjacent to the outer edge 26 of the frame 16.

The downwardly extending grommets 70 of the bumper 50 guide the racquet strings through the holes 42 in the tubular support member 40 of the frame 16. The downwardly extending grommets 70 facilitate the process of stringing the racquet. Once the racquet is strung, the downwardly extending grommets 70 provide support for the newly formed string segments of the racquet. Preferably, the grommets 70 are flexible so as not to inhibit string deflection to any substantial degree.

As shown in FIGS. 4 and 5, the bumper 50 directs the string to bypass at least two holes 42 in the frame 16. The bypass pattern enables string segments that are adjacent each other on the string to be displaced from each other by relatively large distances in the strung racquet. In the illustrated embodiment, the bumper 50 includes a first string path 82, that guides the string from a string anchoring point at a first location 1HL to a string anchoring point at a second location 3HR. A second string path 83 guides the string from an anchoring point at a third location 2HL to an anchoring point at a fourth location 2HR. A third string path 84 guides the string from an anchoring point at a fifth location 3HL to an anchoring point at a sixth location 1 HR.

The first, second, third, fourth, fifth and sixth locations are linearly arranged along the outer surface of the bumper in an order denoted by there identifying characters—the character number indicating relative proximity to the centerline C, with "L" and "R" denoting "left" and "right". Thus, location 2HL is the second location or hole to the left of the center line C.

The third location 2HL is located to one side of the first location 1HL remote from the second location 3HR and the fourth location 2HR is located between the first location 1HL and the second location 3HR. The fifth location 3HL is located to one side of the third location 2HL remote from the first location 1HL and the sixth location 1HR is located between the first location 1HL and the second location 3HR. The second location 3HR is positioned a predetermined distance from the first location 1HL, the fourth location 2HR is positioned a predetermined distance from the third location 2HL and the sixth location 1HR is positioned a predetermined distance from the fifth location 3HL. The distance between locations is predetermined according to a formula discussed below. A raised rim 80 forms the outer edge of the first and third string paths 82 and 84, respectively, thereby confining the strings in the string paths of the bumper 50 and providing the strings some protection from impact.

As shown in FIG. 4, the first string path 82 starts left of the center C of the bumper 50 at an anchoring point or hole at a first location 1HL. The first string path 82 takes the form of a channel extends along the raised rim 80 of the bumper to an anchoring point or hole at a second location 3HR. The first string path 82 guides a portion of the string between the spaced apart anchoring points at locations 1HL and 3HR. The string path positions the string segments such that adjacent string segments on the string are parallel but spaced apart from each other in the string bed of the racquet.

The second string path 83, illustrated in FIG. 4, starts at an anchoring point or hole at a third location 2 HL. A center section of the second string path 83 is positioned outward or topographically above that of the first string path 82. The second string path 83 consists of a beginning channel or trench 83*a* which extends rightward from string hole 2HL, and terminates in an ending channel or trench 83*c* which extends leftward from string hole 2HR. A center section 83*b* of the second string path 83 is shown in dotted line, and bridges and connects portions 83*a* and 83*c*. The center portion 83*b* is topographically above, or elevated with respect to, the channels making up string paths 82 and 84. When a string is disposed in the string paths, the string portions within the first and second string paths do not saw each other.

The second string path 83 extends from an anchoring point or hole at the third location 2HL to an anchoring point or hole at the fourth location 2HR that is positioned to the right of the center C of the bumper 50. The second string path 83 also displaces the string such that adjacent string segments on the string are parallel and spaced apart from each other in the string bed of the racquet. The anchoring points or holes at the third and fourth locations 2HL and 2HR are positioned the same distance from each other as the anchoring points or holes at the first and second locations 1HL and 3HR.

The bumper 50 also includes a third string path 84 that also takes the form of a channel and is substantially parallel to the first and second string paths 82 and 83, respectively. The third string path 84 is positioned such that when the string is disposed in the first, second and third string paths the string portions within the string paths do not saw at each other. As shown in FIG. 4, the third string path 84 guides the string from the anchoring point or hole at a fifth location 3HL along the raised rim 80 of the bumper to the anchoring point or hole at a sixth location 1HR. The holes at the fifth and sixth locations 3HL and 1HR, respectively, are also positioned the same distance from each other as first and second locations 1HL and 3HR and the third and fourth locations 2HL and 2HR. As a result, the third string path also displaces the string such that adjacent string segments on the string are parallel and spaced apart from each other in the string bed of the racquet.

Alternatively, the string may be guided by first, second and third string paths that are formed within the outer face of the outer edge of the racquet itself rather than the outer surface of a bumper.

As illustrated in FIGS. 4 and 5, the string paths guide the string a predetermined distance which causes the string to bypass intermediate anchoring points in the frame of the racquet. The predetermined distance is preselected such that when the racquet hits a projectile, such as a racquet ball, the racquet ball cannot substantially impact adjacent string segments.

The predetermined distance, x, is based on the formula $$x=f(\pi r)$$

where r is the radius of the racquet ball. As shown in FIG. 6, the racquetball 90 substantially flattens as it impacts a racquet. As a result, the width of the surface that the racquetball contacts in the string bed approaches one-half of the circumference of 20 the racquetball. This circumferential distance is $\pi r$, where r is the radius of the projectile. It is desirable that the spacing between connected string segments be at least $(\pi r/2)$, where r is equal to the radius of the racquetball, so that the ball does not substantially impact two string segments, adjacent each other on the string, at the same time. As a result, the string paths extend about 1.8 inches, and preferably the string paths extend approximately 2 inches between connected anchoring points.

Figure 7:
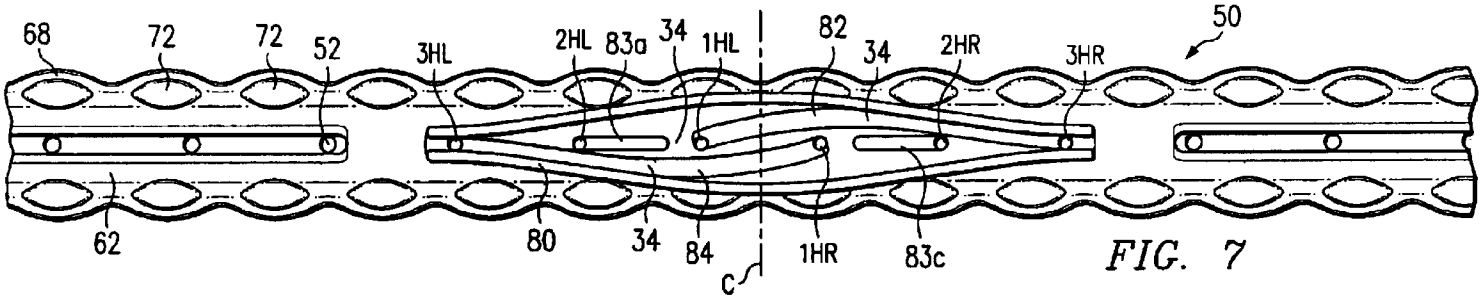
FIG. 7 is a top view of the bumper illustrated in FIG. 4 with a string drawn through the bumper.
Figure 8:
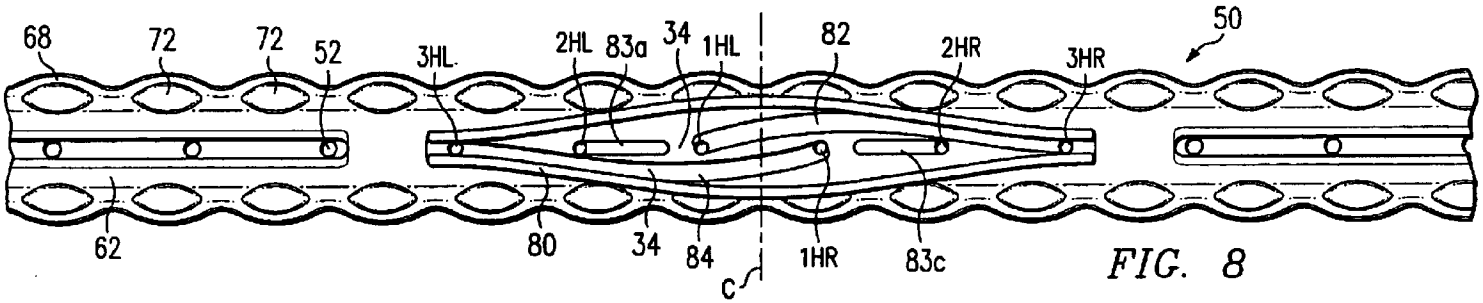
FIG. 8 is a top view of the bumper strung with an alternative string pattern.
Figure 9:
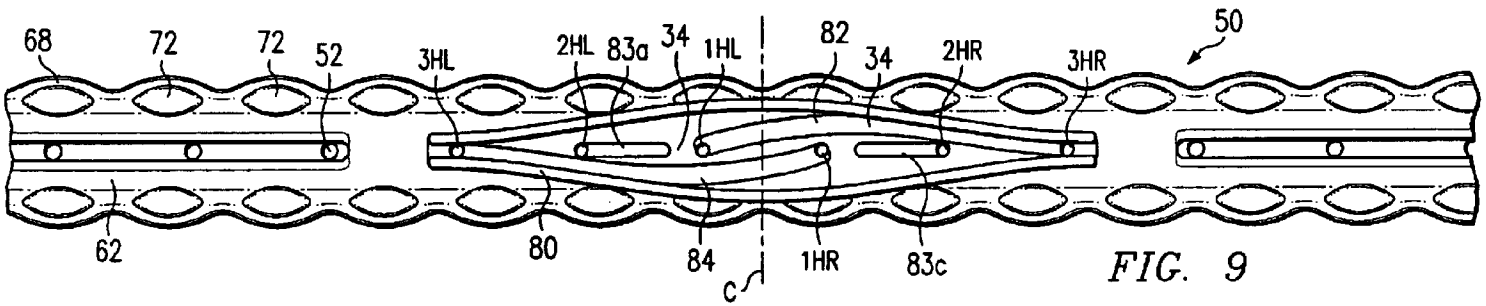
FIG. 9 is a top view of the bumper strung with an alternative string pattern.

FIG. 7 is a top view of the bumper 50 with the racquet string installed therein. As described above, the first string path 82, the second string path 83 and the third string path 84 guide the string to spaced apart anchoring points thereby bypassing adjacent anchoring points. FIG. 8 and FIG. 9 illustrate alternative string patterns where only two overlapping string paths are occupied by a string. FIG. 8 illustrates a string strung through the second string path 83 and the third string path 84. FIG. 9 illustrates a string strung through the first string path 82 and the second string path 83.

Figure 10:
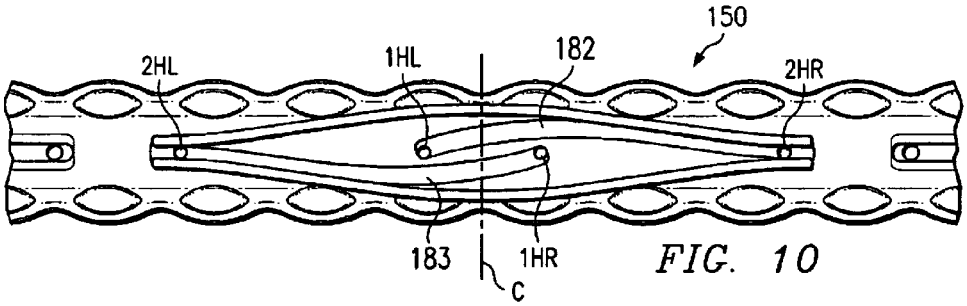
FIG. 10 is a top view of the bumper with an alternative bypass string pattern in which only one hole is bypassed.

FIG. 10 illustrates an alternative bypass pattern that includes two string paths. The string paths in the alternative bypass pattern guide the string to bypass only one string hole. In the illustrated alternative embodiment, the bumper 150 includes a first string path 182 defined between hole 1HL and hole 2HR, with hole 1HR therebetween. The bumper also includes a second string path 183 defined between hole 2HL and hole 1HR, with hole 1HL therebetween. The centerline C is between holes 1HL and 1HR.

Figure 11:
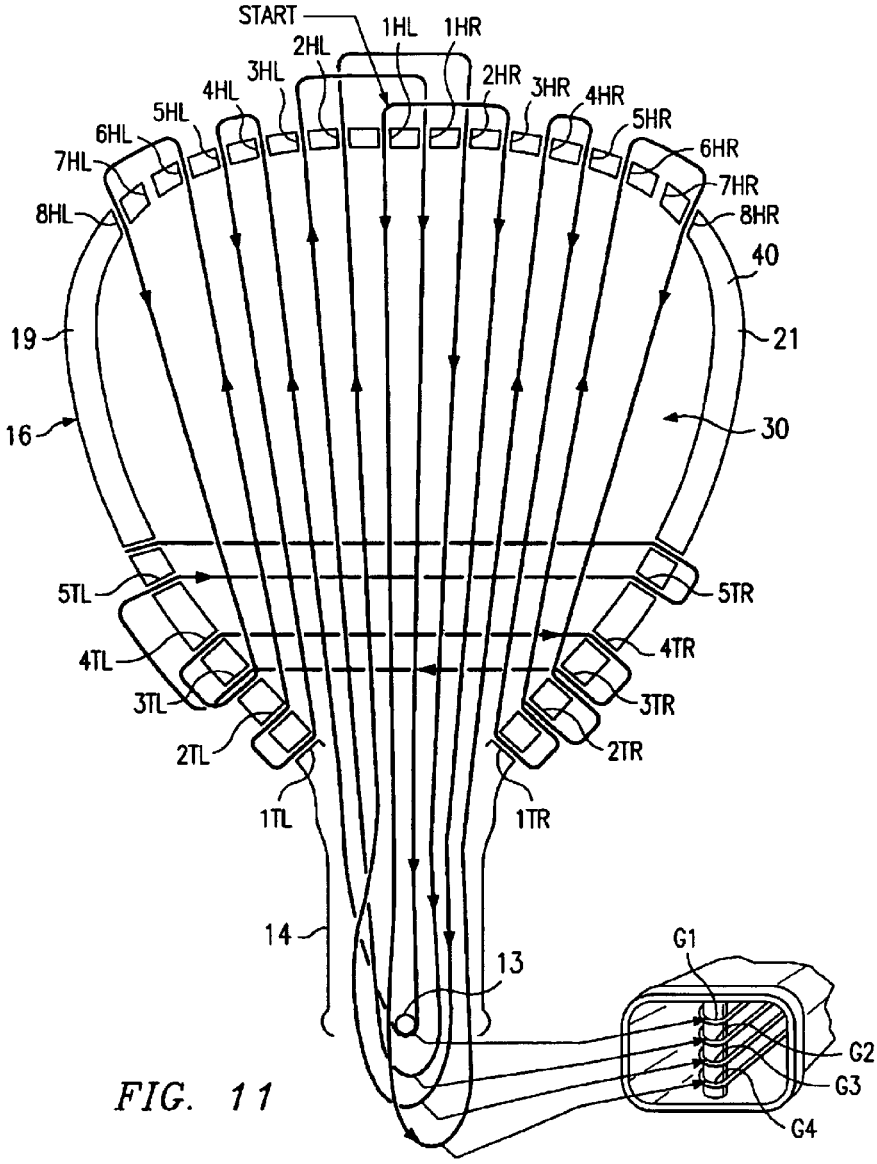
FIG. 11 is a schematic front view of a racquet strung by the bypass string pattern of the present invention.

FIG. 11 illustrates a racquet strung with a bypass pattern according to a preferred embodiment of the present invention. In the illustrated embodiment, the main strings of the racquet are strung by starting at the head of the racquet on the left side at hole 1HL. The short side of the racquet is strung first by feeding a string through the hole 1HL down to the first side of the racquet thereby forming a string segment. The string is wrapped around groove G4 that is disposed in the anchoring pin 13. The string is fed up through the right side of the racquet to hole 4HR thereby forming another string segment. The string is clamped at hole 1HL near the head of the racquet. The string is also tensioned at hole 4HR and then it is clamped near the head of the racquet. The remainder of the short side of the racquet is strung by feeding the string through adjacent hole 5HR and bringing the string down to hole 1TR in the throat of the frame forming a string segment. The string is then drawn over to hole 2TR and back up to hole 6HR at the head of the frame forming a string segment. At each hole, the string is tensioned and clamped before it is drawn to the next hole. From hole 6HR, the string skips hole 7HR and is drawn through hole 8HR. The string is brought down from hole 8HR at the head to hole 3TR located in the throat forming a string segment. The string is tensioned and clamped and brought to adjacent hole 2TR. The string is tied off at hole 2TR.

The long side of the racquet is strung by placing the string from hole 1HL in the first string path 82 which guides the string to hole 3HR. The string is drawn through hole 3HR down to the first side of the racquet thereby forming a string segment. The string is wrapped around groove G3 that is disposed in the anchoring pin 13. The string is fed up the left side of the handle towards the head and hole 2HL forming a string segment. Next, the string is fed through hole 2HL and then positioned in the second string path 83. The second string path 83 guides the string to hole 2HR. The string is fed through hole 2HR and drawn to the first side of the racquet forming a string segment. The string is wrapped around groove G2 that is disposed in the anchoring pin and brought up the left side of the handle to the head of the racquet forming a string segment. The string is brought through hole 3HL, tensioned and clamped near the head of the racquet. The string is positioned in the third string path 84 and guided to hole 1HR. The string is fed down through hole 1HR towards the first side of the racquet forming a string segment. The string is wrapped around groove G1 that is disposed in the anchoring pin. The string is brought back to the second side or head of the racquet to form a string segment. The string is then drawn through hole 4HL, tensioned and clamped.

The remaining main strings on the long side of the racquet are strung by guiding the string from hole 4HL to adjacent hole 5HL. The string is brought down through hole 5HL to hole 1TL in the throat of the left side of the racquet thereby forming a string segment. The string is tensioned and clamped. The string is drawn through adjacent hole 2TL and up through hole 6HL forming a string segment. The string is again tensioned and clamped. The string is guided past hole 7HL and drawn through hole 8HL. The string is fed down to hole 3TL to form the last vertical string segment, tensioned and clamped.

The cross strings of the racquet are formed by feeding the string up to hole 4TL and under the first main string segment. The string is then weaved through the vertical string segments across the racquet to hole 4TR. The string is tensioned and clamped near hole 4TR. The string is fed down and through hole 3TR. The string is then weaved across the vertical string segments of the racquet to hole 3TL on the left side of the racquet. The string is brought up the frame of the racquet and drawn through hole 5TL. The string is weaved across the vertical string segments back to the right side of the racquet and through hole 5TR. The string is tensioned and clamped near hole 5TR. The remaining cross strings are formed in an identical fashion by bringing the string through a hole on the right side of the racquet, weaving the string across the racquet and drawing the string through a hole on the left side of the racquet.

FIG. 12 schematically illustrates a bypass string pattern used on the cross strings. As starting at location 301 on the left side of racquet 350, string is passed to right side location 302. Right side locations 304, 306 and 308 are skipped and location 310 is used to pass this string back through the bed to left location 309. The string is then routed downward past consecutive left locations 307 and 305 to location 303, to begin another stringing cycle. The stringing pattern results in string-adjacent cross string segments which are three segments apart from each in the string bed.

While a bypass string pattern skipping two holes is illustrated and described, the bypass string pattern could include skipping any larger desired number of holes, such as three or a mixture thereof to string the racquet. The bypass string pattern may also be implemented on racquets that are strung in a different order than the illustrated embodiment.

The string paths disposed in the bumper simplify the process of stringing the racquet and provide a guide for the bypass string pattern. The bypass pattern enables the user to position adjacent string segments a distance apart from each other in the string bed. As a result, in use, a ball will not substantially impact both of two directly connected main string segments at the same time. Adjacent string segments are able to relieve some of the stress placed in the string segments that are impacted by the ball. The main string segments are able to move independent of each other resulting in a livelier ball response and a longer string life.

Therefore, while the invention has been described with respect to the illustrated embodiment, it is not limited thereto, but only by the scope and spirit of the appended claims.

I claim:

1. A sports racquet comprising:

a handle;

a frame operatively connected to the handle and defining a strung area, the frame having a string support member having first and second side portions on opposed sides of the strung area;

a plurality of string segments strung across the strung area; and an outer face disposed around an outer edge of the frame, having first through sixth locations linearly arranged in an order of fifth, third, first, sixth, fourth and second locations along the outer edge, string segments terminating at each of the locations;

a first string path disposed in the outer face between the first and second locations, a second string path disposed in the outer face between the third and fourth locations and displaced from the first string path, a third string path disposed in the outer face between the fifth and sixth locations, so that string portions disposed in the first, second and third string paths on the outer face do not saw any of the others.

2. The sports racquet of claim 1, wherein the second string path includes a portion which is disposed outwardly of the first string path, such that the string paths mitigate the sawing of string portions in the first and second string paths against each other.

3. The sports racquet of claim 1, wherein the outer face is formed by a bumper.

4. The sports racquet of claim 1, wherein a bumper fitted to the frame is used to define the first and second string paths.

5. The sports racquet of claim 1, wherein the first and second sides are two lateral sides connected by cross strings.

6. The sports racquet of claim 1, wherein the first side is at a throat of the racquet.

7. A sports racquet, comprising:

a frame having a first side and an opposed second side, at least the second side having a plurality of spaced apart string anchoring points;

a string bed strung on the frame using the string anchoring points, the string bed comprising a string having a plurality of string segments each strung between the first side and the second side, first and second string segments being adjacent to each other on the string, and being substantially parallel to each other in the string bed, but being spaced apart from each other in the string bed by at least two string segments strung substantially in parallel with the first and second string segments, the racquet having a hollow handle defining a chamber, a transverse anchoring pin in the chamber positioned remotely from the string bed, the first and second string segments being strung from the anchoring pin to the second side.

8. A method for stringing a sports racquet adapted for hitting a projectile, comprising the steps of:

from a first side of a racquet frame, drawing a string toward a second side opposite the first side to form a first string segment;

stringing the string through a string anchoring point at a first location on the second side;

drawing the string from the first location on the second side to a second location on the second side spaced from the first location;

stringing the string through a string anchoring point at the second location;

passing the string back to the first side of the frame to form a second string segment;

passing a third segment of the string from the first side of the frame to a third location on the second side of the frame, the third location disposed between the first and second locations;

stringing the string through a string anchoring point at the third location;

drawing the string from the third location on the second side to a fourth location on the second side, the second location interposed between the third location and the fourth location;

stringing the string through a string anchoring point at the fourth location;

passing a fourth segment of the string back to the first side of the frame;

passing a fifth segment of the string from the first side of the frame to a fifth location on the second side of the frame, the fifth location disposed between the second location and the third location;

stringing the string through a string anchoring point at the fifth location;

drawing the string from the fifth location on the second side to a sixth location on the second side, the fourth location interposed between the sixth and second locations; and passing a sixth segment of the string back to the first side of the frame, respective distances between the first and second location, the third and fourth location, and the fifth and sixth location preselected such that a projectile cannot substantially impact both the first and second string segments, or both the third and fourth string segments, or both the fifth and sixth string segments.

9. The method of claim 8, wherein the first and second sides are lateral sides connected by cross strings.

10. The method of claim 8, wherein the step of drawing the string from the first location on the second side includes drawing the string a distance of at least 2 inches to the second location on the second side.

11. A method for stringing a sports racquet adapted for hitting a projectile, comprising the steps of:

from a first side of a racquet frame, drawing a string toward a second side opposite the first side to form a first string segment;

stringing the string through a string anchoring point at a first location on the second side;

drawing the string from the first location on the second side to a second location on the second side spaced from the first location;

stringing the string through a string anchoring point at the second location;

passing the string back to the first side of the frame to form a second string segment;

passing a third segment of the string from the first side of the frame to a third location on the second side of the frame, the first location disposed between the second and third locations;

stringing the string through a string anchoring point at the third location;

drawing the string from the third location on the second side to a fourth location on the second side, the fourth location interposed between the first location and the second location;

stringing the string through a string anchoring point at the fourth location;

passing a fourth segment of the string back to the first side of the frame;

passing a fifth segment of the string from the first side of the frame to a fifth location on the second side of the frame, the third location disposed between the first location and the fifth location;

stringing the string through a string anchoring point at the fifth location;

drawing the string from the fifth location on the second side to a sixth location on the second side, the sixth location interposed between the first and fourth locations; and passing a sixth segment of the string back to the first side of the frame, respective distances between the first and second locations, the third and fourth locations, and the fifth and sixth locations preselected such that a projectile cannot substantially impact both the first and second string segments, or both the third and fourth string segments, or both the fifth and sixth string segments.

12. The method of claim 11, wherein the first side is at a throat of a racquet.

13. The method of claim 11, further comprising the steps of: defining a first string path in an outer face of the racquet frame from the first location to the second location;

defining a second string path in the outer face from the third location to the fourth location so as to be displaced from the first string path;

defining a third string path in the outer face from the fifth location to the sixth location so as to be displaced from the first and second string paths;

stringing the string using the string paths such that segments of the strings disposed on the outer face do not saw each other.

14. The method of claim 13, and further comprising the step of: using a bumper to define the string paths in the outer face.

15. The method of claim 11, wherein the step of drawing the string from the first location on the second side includes drawing the string a distance of at least two inches to the second location on the second side.

* * * * *